US006796608B2

(12) United States Patent
Ventimiglia et al.

(10) Patent No.: US 6,796,608 B2
(45) Date of Patent: Sep. 28, 2004

(54) TENNIS " TEACHING-SEAT" ASSEMBLY

(76) Inventors: Kenneth J. Ventimiglia, 38 Castleview Dr., Gloucester, MA (US) 01930; Bruce McGrath, Boardman Ave., Manchester, MA (US) 01944

( * ) Notice: Subject to any disclaimer, the term of this patent is extended or adjusted under 35 U.S.C. 154(b) by 0 days.

(21) Appl. No.: 10/267,550

(22) Filed: Oct. 9, 2002

(65) Prior Publication Data

US 2004/0070241 A1 Apr. 15, 2004

(51) Int. Cl.[7] ..... A47C 7/62; A47C 31/00; A47C 1/02; B60N 2/38

(52) U.S. Cl. ..... 297/217.1; 297/195.11; 297/188.01; 297/217.3; 297/331; 297/184.16

(58) Field of Search ..... 297/217.1, 195.11, 297/188.01, 217.3, 331, 184.16; 248/229.13, 229.14, 231.51, 231.61, 230.3, 230.4, 125.1, 298.1; 403/289, 290, 340; 182/187

(56) References Cited

U.S. PATENT DOCUMENTS 765,980 A * 7/1904 Mercier ..... 396/329
773,813 A * 11/1904 Saegmuller ..... 248/231.61
1,114,948 A * 10/1914 Walker ..... 108/5
1,236,960 A * 8/1917 McMillian ..... 248/219.1
1,893,702 A * 1/1933 Glenn ..... 248/218.4
3,131,964 A * 5/1964 Reed ..... 297/13
3,843,083 A * 10/1974 Angibaud ..... 248/229.14
4,129,198 A * 12/1978 Hunter ..... 182/187
5,630,566 A * 5/1997 Case ..... 248/122.1
5,933,668 A * 8/1999 Hyers ..... 396/392
6,224,153 B1 5/2001 Vodinh
6,244,557 B1 * 6/2001 Maze ..... 248/541
6,450,465 B1 * 9/2002 Eslick ..... 248/230.4
2002/0145316 A1 * 10/2002 Oliver ..... 297/217.1

* cited by examiner

*Primary Examiner*—Peter M. Cuomo
*Assistant Examiner*—Sarah C. Burnham

(57) ABSTRACT

A tennis teaching seat assembly for attachment to a vertical tennis net support post for the instruction and recordation of a tennis match. The assembly comprises a tennis net post attachable shaft having an upper first bracket and a lower second bracket thereon. A hinged seat and seat support bracket is attached to the tennis post attachable shaft. The first bracket and the second has a tennis post gripping arrangement therein to permit the seat assembly to securely be attached to any tennis post. The gripping arrangment comprises an insert matable within one of each of the first and second brackets.

12 Claims, 5 Drawing Sheets

TENNIS " TEACHING-SEAT" ASSEMBLY

BACKGROUND OF THE INVENTION

1. Field of the Invention

This invention relates to seating apparatus for tennis instructors and more particularly to a seat and work station adaptable to a tennis court to facilitate teaching of the sport of tennis.

2. Prior Art

The coaching of tennis players is done in very fast paced and reflective situations. Tennis matches are typically played in bright sun and their pace of movement is very fast. To be an effective instructor in such a sport it is necessary to be able to often watch both sides of the net as the players interact, as well as to record and advise one or both players on their respective sides of the net. Seating arrangements to accomplish this goal must also be adaptable to permit their use on further tennis courts elsewhere and must be relatively portable and collapsible so as to minimize their obtrusiveness on the court during play and during court maintenance. Such a seat apparatus should also minimize any loosening or pulling upon the vertical post which supports the tennis net.

U.S. Pat. No. 6,224,153 to Vodinh shows a folding seat assembly for use with a vertical post at a sporting event. This particular seat assembly discloses two opposed seat portions on opposite sides of the post which supports a tennis net. Difficulties would arise with this arrangement, in use by a tennis instructor because the instructor would either be in the way of play or would not be facing or able to see the player behind the tennis instructor. Further, the weight of the instructor would be pulling sideways on the post and not in line with a tennis net so as to tension. It would be acting to loosen or bend and pull down the post.

It would be desirable to have a seat apparatus capable of supporting a reasonable amount of weight without any strain on the tennis net post and it would be desirable to permit the instructor to watch both sides of the tennis net simultaneously.

It is an object of the present invention to-overcome the disadvantages of the prior art.

It is a further object of the present invention to provide a tennis net seat assembly which is readily portable, removable from a tennis post without cumbersome tools in a manner that is an improvement over the prior art.

It is yet a further object of the present invention to provide a tennis net seat arrangement which is adaptable to a variety of tennis net post sizes, diameters and/or cross sectional shapes.

It is still yet another object of the present invention to provide a tennis net seat assembly which permits the tennis instructor thereon some protection from the sun, and the ability to record or write as the tennis match is in play from a position right against the court yet not in the way of the players and without danger to the players or to the coach.

It is still yet a further object of the present invention to provide a tennis net seat assembly which may be swingably adjustable and readily adaptable to the particularities of the tennis instructor.

BRIEF SUMMARY OF THE INVENTION

The present invention comprises a tennis net seat assembly for use as a teaching station by a tennis pro at a tennis court. The tennis net seat assembly is a portable, removable arrangement which is securable to a vertical tennis net support post typically utilized to hold up a horizontally arranged tennis net between a first and a second post on the other side of the tennis court.

The tennis net seat assembly comprises an elongated attachable support shaft, about three to four feet in length, having an adjustable upper attachment bracket and a lower adjustable attachment bracket thereon. The upper (and lower) attachment bracket has a first end and second end. The first end of the upper attachment bracket has a receiving bore or opening extending therethrough. A threaded adjustable locking bolt extends through the side portion of the first end of the upper attachment bracket and into the bore therewithin. The second end of the upper attachment bracket comprises a semicircular frame portion which is unitary with the first end of the upper attachment bracket. A generally semicircular frame portion is attached by a hinge to the unitary side of the upper attachment bracket. A swingable threaded adjustment locking bolt is pivotably secured to a flange on the framed portion of the second end and is engageable in a locking position on a flange on the semicircular hinged portion of the second end of the upper attachment bracket. A support bore is arranged between the two components of the second end of the upper attachment bracket. The support bore defines a cavity in which an insert may be placed.

The support bore in the preferred embodiment is of generally square or rectilinear configuration having a cavity arranged on an inner wall thereof. A second and third partial cavity are each arranged on adjacent wall segments of the hinged semicircular frame. Corresponding second and third partial cavities and a primary cavity are similarly arranged on the framed portion of the upper attachment bracket. The cavities are arranged so as to receive in a mating fashion the ears on the outer sides of an insert which may be received within the support bore. The support bore being a rectilinear shape is preferably about three inches on a side therein. This three inch sided square shape is arranged to mate about a three inch square post which may be utilized to hold up a tennis net.

In a further embodiment of the present invention, a split insert would mate within the inner walls of the support bore. The split insert would have peripheral walls of square configuration having side ears and split ears which mate respectively with the cavity and second and third partial cavities on the inner wall portions of the second end of the upper attachment bracket. The split insert would be preferably made from an injected plastic and have an inner opening which may be either circular or square or star shaped so as to circumferentially surround and be secured to a "correspondingly-shaped" tennis net support post. The lower adjustable support bracket arranged on the attachable support shaft is generally similar to the upper attachment bracket arranged thereon.

A seat support bracket is vertically adjustably arranged about a position between the upper support bracket and the lower support bracket on the vertical support shaft. The seat bracket has a first end with a bore extending therethrough. A threaded bolt is adjustably received within a sidewall portion of the first end of the seat bracket so as to tighten that seat bracket against the vertical support shaft of the tennis net seat assembly. The seat bracket has a second end of generally U-shape. The U-shape receives a flange on the first end of a scat support. The seat support has a second end with a generally triangularly shaped seat member thereon. The second end of the seat bracket includes an access for pivotably receiving the seat flange thereon, and the second end of the seat bracket has a second bore therethrough for receiving a securement pin which lines up with an alignment bore within the flange of the first end of the seat bracket. Removal of the pin from its bore will permit the first end of the seat bracket to swing about its axis into either a vertical or a generally horizontal position.

The vertically arranged support shaft has an upper end with a generally horizontally arranged support bar thereon. The horizontal support bar has an opening arranged along a mid portion thereof. An adjustable threaded bolt member is received through the opening on the horizontal support bar and is secured to the top of the vertical support shaft, to permit that horizontal support bar to be moved left or right relative to the vertical shaft. The horizontal support bar in one embodiment has a clamp at a first end thereof. The clamp at the first end is arranged to support a still or video type camera.

The horizontal support bar has a second end which is arranged to support an adjustable document writing surface thereon. The adjustable document writing surface has a hinged clamp which permits secure adjustable orientation of that surface with respect to the second end of the horizontal support bar and adjustment of a clip board with respect to the coach. A shade umbrella may be arranged on the side of the vertical support shaft in a receiving member thereon.

A further embodiment of the horizontal support bar comprises a plurality of spaced apart holes extending therethrough replacing the open slot in the aforementioned embodiment. This permits the horizontal support bar to be more rigidly locked in place relative to the vertical support shaft on which the seat bracket is attached.

By virtue of having the seat support bracket and the seat in planar alignment with the tennis net supported by the tennis net posts, tension is maintained within the tennis net and no damage is caused to that tennis net support post. Such a seating arrangement also permits the tennis pro to not only watch both sides of the net simultaneously yet safely out of way of the action going on but to enable that tennis pro to record the play, make notes on a document for further instruction subsequent to the tennis play and generally supervise the tennis lesson in a far more appropriate manner than heretofore has been able.

The invention thus comprises a tennis teaching seat assembly for attachment to a vertical tennis net support post for the instruction and recordation of a tennis match. The assembly comprises a tennis net post attachable shaft having an upper first bracket and a lower second bracket thereon. A hinged seat and seat support bracket is attached to the tennis post attachable shaft. The first bracket and the second bracket have a tennis post gripping arrangement therein to permit the seat assembly to securely be attached to any tennis post. The gripping arrangement may comprise an insert matable within one of each of the first and second brackets. The insert may be splitable. The first and second brackets have a bore therein to receive the insert. The seat is pivotable from a generally horizontal position to a vertical position. A horizontal support bar is adjustably arranged on an upper end of the tennis post attachable shaft. The horizontal support bar has a first end for adjustably supporting a camera member. The horizontal support bar has a second end for adjustably supporting an adjustable support surface. The horizontal support bar has a central opening arrangement to permit the bar to be horizontally adjusted with respect to the shaft. The central opening in the support bar may be an elongated opening. The seat support bracket is in alignment with a tennis net supported by said tennis net support post. An umbrella may be supportively attached to the shaft to shield a tennis pro during a tennis lesson. The tennis seat may be vertically adjustable on said tennis post attachable shaft. The tennis post gripping arrangement may comprise a rectilinear opening in the first and second brackets. The rectilinear opening may have a plurality of cavities therein to permit a post gripping insert to be secured therein. The post gripping insert may have an ear arranged externally thereon for receipt in the cavity in the rectilinear opening. The hinged movable seat, while sideways adjustable, is arranged to help keep the tension on a net supported on the tennis net support post when a tennis instructor is viewing a tennis match therefrom, and not pull significantly to one side.

DESCRIPTION OF THE DRAWINGS

The objects and advantages of the present invention will be become more apparent when viewed in conjunction with the following drawings in which.

DESCRIPTION OF THE PREFERRED EMBODIMENTS

Figure 1:
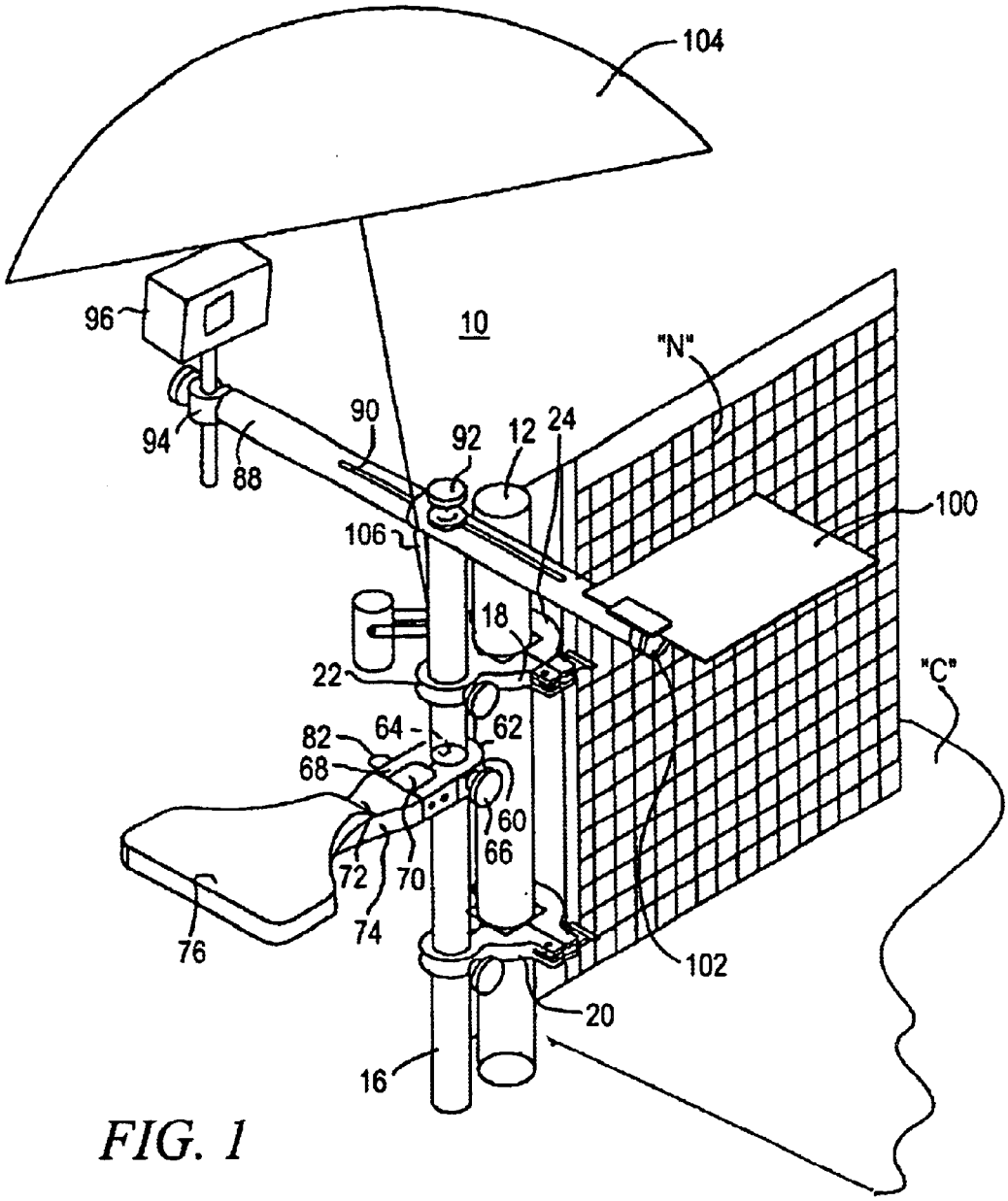
FIG. 1 is a perspective view of a tennis net seat-assembly attached to a tennis net support post.
Figure 2:
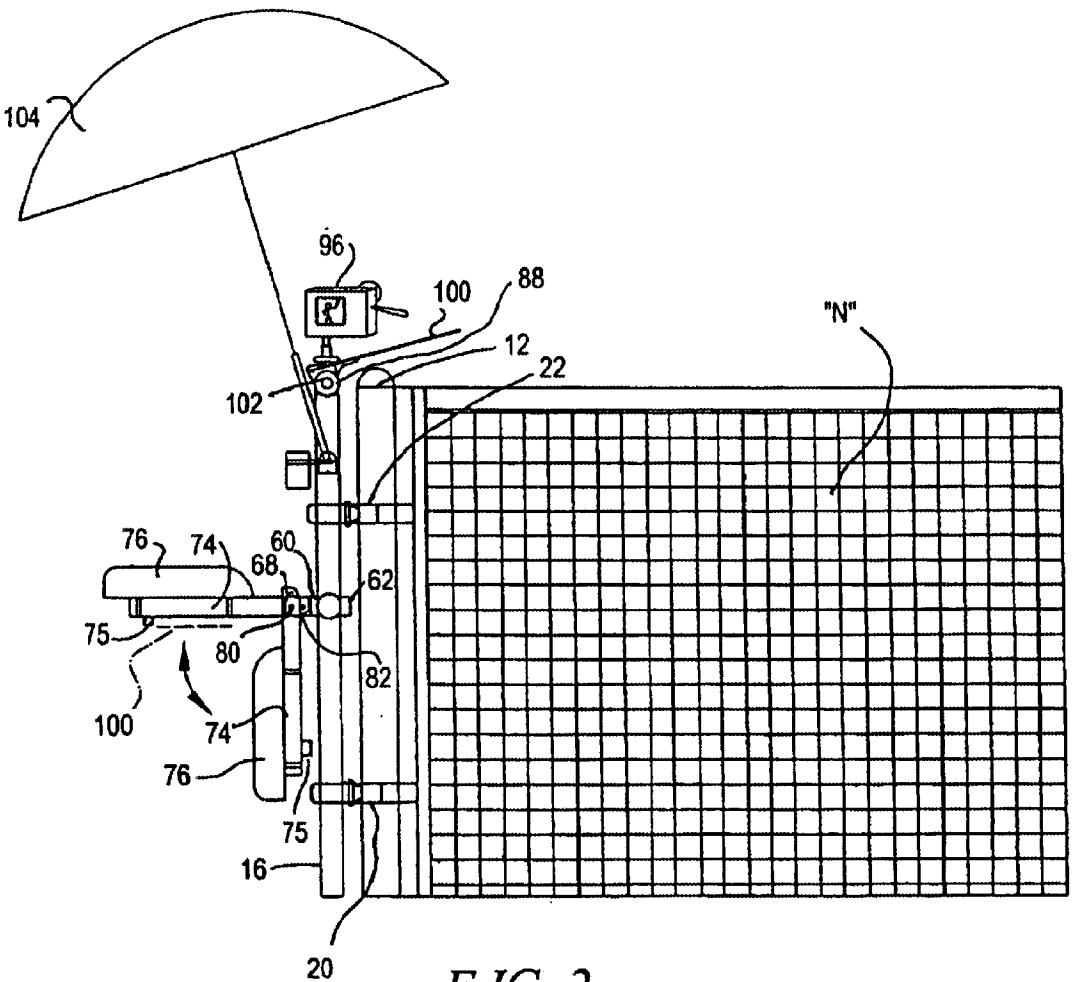
FIG. 2 is a side elevational view of the tennis net seat assembly shown in FIG. 1, and is a partial showing of the tennis net and its respective support post thereadjacent.

Referring now to the drawings in detail, and particularly to FIGS. 1 and 2 there is shown the present invention which comprises a tennis net seat assembly 10 for use as a teaching station by a tennis pro at a tennis court. The tennis net seat assembly 10 is a portable, removable arrangement which is securable to a vertical first tennis net support post 12 typically utilized to hold up a horizontally arranged tennis net "N" and a second tennis net support post (not shown) on the other side of the tennis court "C".

Figure 4:
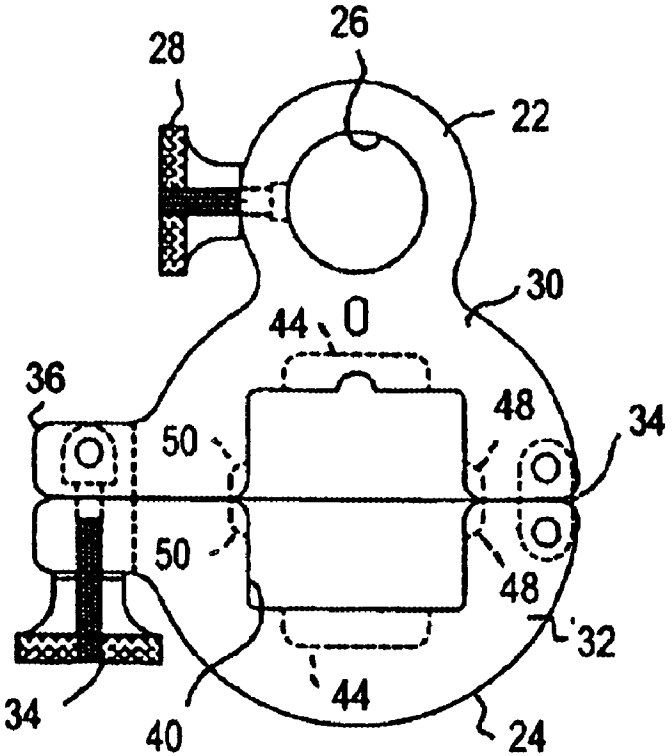
FIG. 4 is a view similar to FIG. 3 of the attachment bracket shown without an insert therewithin.
Figure 6:
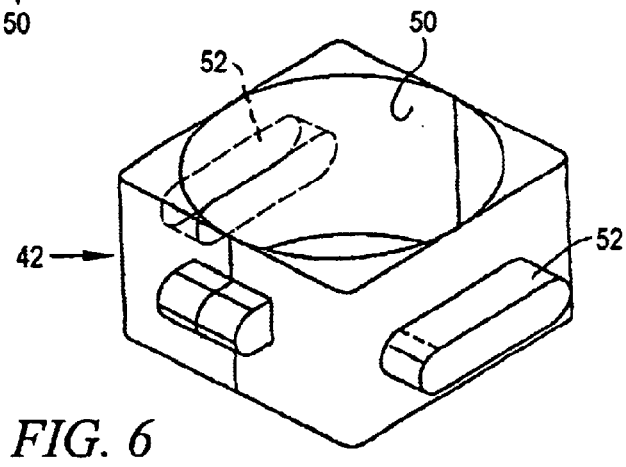
FIG. 6 is a perspective view of an insert which is received within the attachment bracket.

The tennis net seat assembly 10 comprises an elongated attachable vertically arranged support shaft 16, about three to four feet in length, having an adjustable upper attachment bracket 18 and a lower adjustable attachment bracket 20 thereon. The upper (and lower #20 ) attachment bracket 18 has a first end 22 and second end 24, as shown more clearly in FIGS. 3 and 4. The first end 22 of the upper attachment bracket 18 has a receiving bore or opening 26 extending therethrough. A threaded adjustable locking bolt 28 extends through the side portion of the first end 22 of the upper attachment bracket 18 and into the bore 26 therewithin. The second end 24 of the upper attachment bracket 18 comprises a semicircular frame portion 30 which is unitary with the first end 22 of the upper attachment bracket 18. A generally semicircular frame portion 32 is attached by a hinge to the unitary (first) side 22 of the upper attachment bracket 18. A swingable threaded adjustment locking bolt 34 is pivotably secured to a flange 36 on the flamed portion 30 of the second end 24 and is engageable in a locking position on a flange 38 on the semicircular hinged portion 32 of the second end 24 of the upper attachment bracket 18. A support bore 40, shown empty in FIG. 4, is arranged between the two components 30 and 32 of the second end 24 of the upper attachment bracket 18. The support bore 40 defines a cavity in which an insert 42, shown in FIGS. 3 and 6, may be placed.

Figure 3:
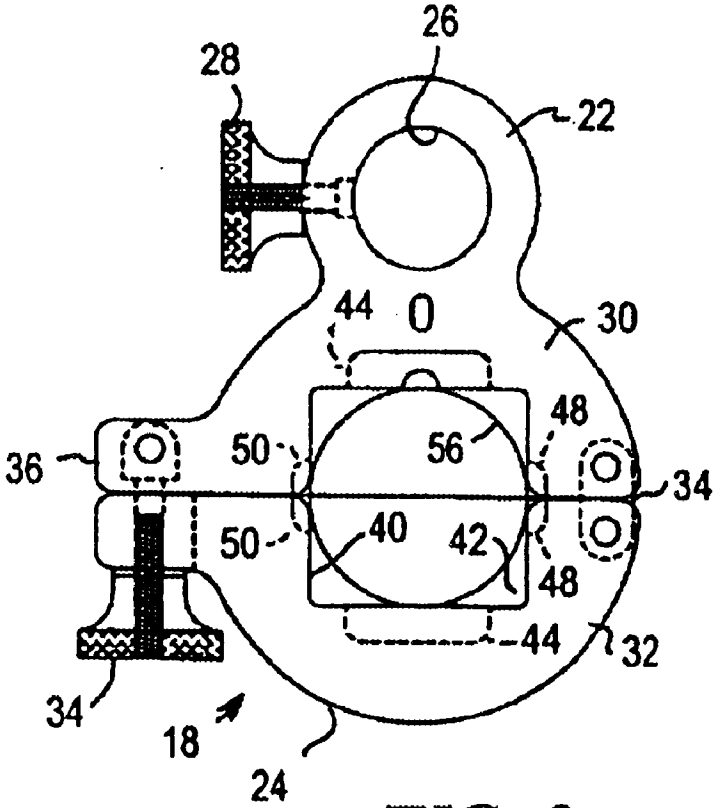
FIG. 3 is a plan view of an upper attachment bracket with an insert shown arranged therewithin.
Figure 5:
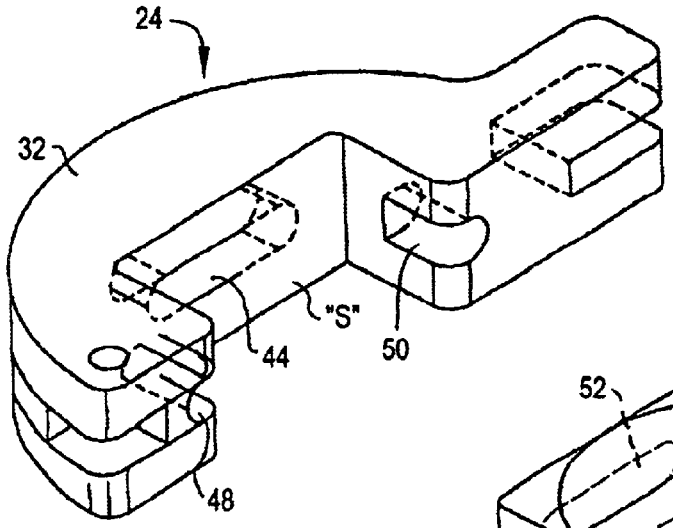
FIG. 5 is a perspective view of the generally semicircular second end of the attachment bracket.

The support bore 40 in the preferred embodiment is of generally square or rectilinear configuration having a cavity 44 arranged on an inner wall 46 thereof. A second and third partial cavity 48 and 50 are each arranged on adjacent wall segments of the hinged semicircular frame 24, as shown in FIG. 5. Corresponding second and third partial cavities 48 and 50 and a primary cavity 44 are similarly arranged on the framed (first end 22) portion of the upper attachment bracket 18. The cavities 44, 48 and 50 are arranged so as to receive in a mating fashion the ears 52 on the outer sides of an insert 42, shown in perspective in FIG. 6, which may be received within the support bore 40, as represented in FIG. 3. The support bore 40 being a rectilinear shape is preferably about three inches on a side "S" therein. This three inch sided square shape is arranged to mate about a three inch square post 20 which may be utilized to hold up a tennis net "N".

In a further embodiment of the present invention, a split insert 42 would mate within the inner walls 46 of the support bore 40, as shown in FIG. 3. The split insert 42 would have peripheral walls of preferably square configuration having side ears 52 and split ears 54 which mate respectively with the cavity 44 and second and third partial cavities 48 and 50 on the inner wall portions 46 of the second end 24 of the upper attachment bracket 18. The split insert 42 would be preferably made from an injected plastic and have an inner opening 56 which may be either circular or square or star shaped so as to circumferentially (peripherally) surround and be secured to a "correspondingly-shaped" tennis net support post 12. The lower adjustable support bracket 20 arranged on the attachable support shaft 16 is generally similar to the upper attachment bracket 18 arranged thereon. A hole 39 may be arranged in the frame portion 30, as shown in FIG. 4, so as to receive a security cable therethough, not shown for clarity, to permit the assembly 10 to be locked to a tennis net post 12.

A loosenable seat support bracket 60 is vertically adjustably arranged about a position between the upper support bracket 18 and the lower support bracket 20 on the vertical support shaft 16, as shown in firues 1 and 2. The seat bracket 60 has a first end 62 with a bore 64 extending therethrough. A threaded bolt 66 is adjustably received within a sidewall portion of the first end 62 of the seat bracket 60 so as to tighten that seat bracket 60 against the vertical support shaft 16 of the tennis net seat assembly 10, or permit a seat 76 thereon to be swiveled sideways. The seat bracket 60 has a second end 68 of generally U-shape, as may be seen in FIG. 1. The U-shaped end receives a flange 70 on the first end 72 of a seat support 74. The seat support 74 has a second end with the generally triangularly shaped seat 76 member thereon. The second end 68 of the seat bracket includes an axis 80 for pivotably receiving the seat flange thereon, and the second end of the seat bracket 60 has a second bore therethrough for receiving a securement pin 82 which lines up with an alignment bore within the flange of the first end of the seat bracket 60. Removal of the pin 82 from its bore will permit the first end of the seat bracket 60 to swing about its axis 80 into either a vertical or a generally horizontal position, as indicated in FIG. 2.

Figure 7:
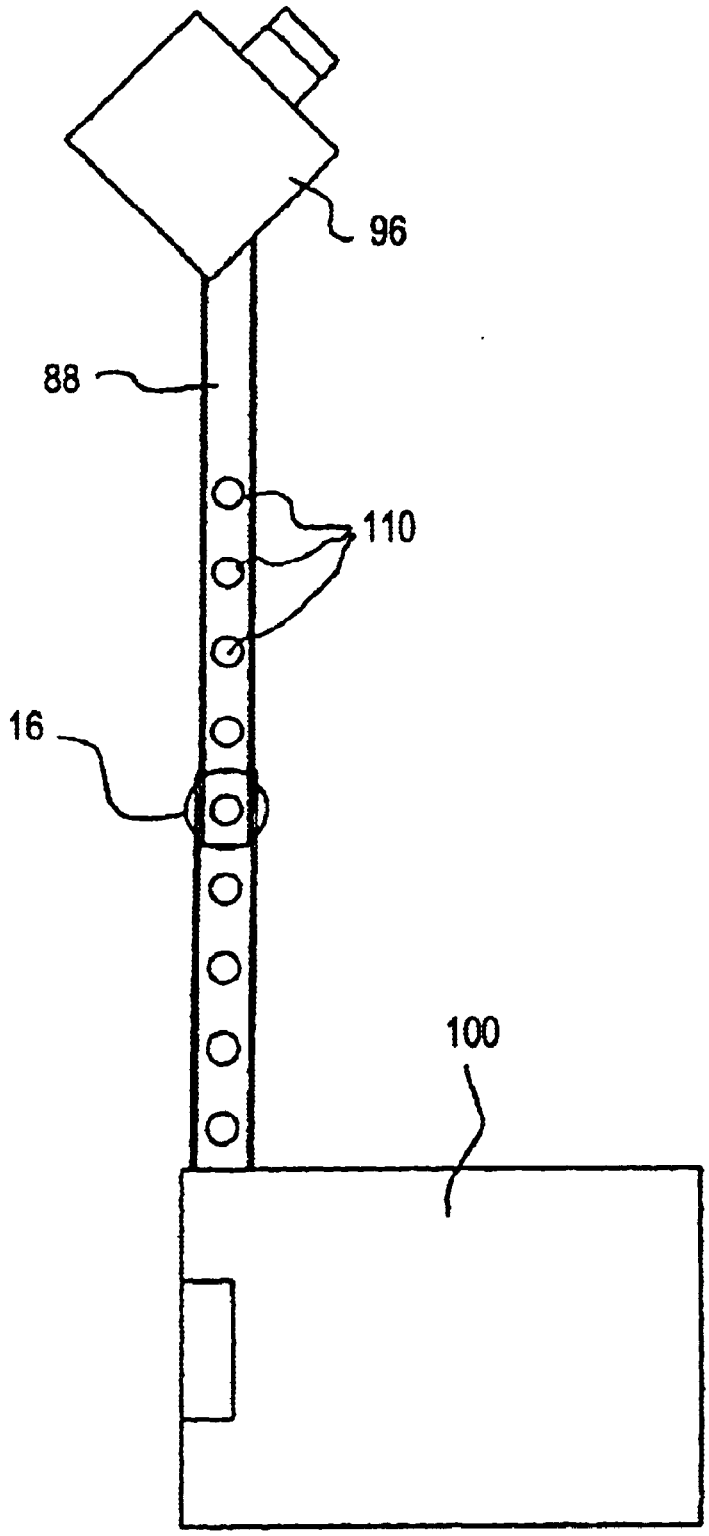
FIG. 7 is a planned view of the horizontal support bar with a camera and a document support pad arranged on its respective ends.

The vertically arranged support shaft 16 has an upper end with a generally horizontally arranged support bar 88 thereon, as shown in FIGS. 1, 2 and 7. The horizontal support bar 88 has an opening 90 arranged along a mid portion thereof, as may be seen in FIG. 1. An adjustable threaded bolt member 92 is received through the opening 90 on the horizontal support bar 88 and is secured to the top of the vertical support shaft 16, to permit that horizontal support bar 88 to be moved left or right relative to the vertical shaft 16. The horizontal support bar 88 in one embodiment has a clamp 94 at a first end thereof. The clamp 94 at the first end is arranged to support a video camera 96. The shaft 16, being hollow, may receive the bar 88 through the upper end of the shaft 16 for storage and transport The horizontal support bar 88 has a second end which is arranged to support an adjustable document writing surface 100 thereon. The adjustable document writing surface 100 has a hinged clamp 102 which permits secure adjustable orientation of that surface 100 with respect to the second end of the horizontal support bar 88. A shade umbrella 104 may be arranged on the side of the vertical support shaft 16 in a receiving member 106 thereon. The seat support 74 has a clip 75 to hold the writing surface 100 during storage or transport of the assembly 10, as shown in FIG. 2.

A further embodiment of the horizontal support bar 88 is shown in FIG. 7 which comprises a plurality of spaced apart holes 110 extending therethrough replacing the open slot in the aforementioned embodiment. This permits the horizontal support bar 88 to be more rigidly locked in place relative to the vertical support shaft 16 on which the seat bracket 60 is attached.

By virtue of having the seat support bracket 60 and the seat 76 in planar alignment with the tennis net "N" supported by the tennis net posts 12, tension is maintained within the tennis net "N" and no damage is caused to that tennis net support post 12. Such a seating arrangement also permits the tennis pro to not only watch both sides of the net simultaneously yet the out of way of the action going on but to enable that tennis pro to record the play, make notes on a document for further instruction subsequent to the tennis play and generally supervise the tennis lesson in a far more appropriate manner than heretofore has been able.

The appended claims are intended to be interpretive only and not intended to limit the invention to its exact construction shown and described, all suitable modification and equivalents may be resorted to, falling within the scope of the invention.

We claim:

1. A tennis teaching seat assembly for attachment to a vertical tennis net support post for use as an instruction and recordation aid at a tennis match, comprising:

a tennis net post attachable shaft having an upper first bracket and a lower second bracket thereon;

a hinged seat and a seat support bracket attached to said tennis net post attachable shaft;

said first bracket and said second bracket having a tennis post gripping arrangement, said gripping arrangement comprising an insert matable within one of each of said first and second brackets arranged therein to permit said seat assembly to be removably attached to a tennis post of any cross-section including a horizontal support bar adjustably arranged on an upper end of said tennis net post attachable shaft, wherein said horizontal support bar has a first end for adjustably supporting a camera member, and wherein said horizontal support bar has a second end for adjustably supporting an adjustable support surface, wherein said horizontal support bar has a central opening arrangement to permit said bar to be horizontally adjusted with respect to said tennis net post attachable shaft.

2. The tennis teaching seat assembly as recited in claim 1, wherein said insert is splitable.

3. The tennis teaching seat assembly as recited in claim 1, wherein said first and second brackets have a bore therein to receive said insert.

4. The tennis teaching seat assembly as recited in claim 1, wherein said seat is pivotable from a generally horizontal position to a vertical position.

5. The tennis teaching seat assembly as recited in claim 1, wherein said central opening in said support bar is an elongated opening.

6. The tennis teaching seat assembly as recited in claim 1, wherein said seat support bracket is in alignment with a tennis net supported by said tennis net support post.

7. The tennis teaching seat assembly as recited in claim 1, including an umbrella supportably attached to said tennis net post attachable shaft to permit said umbrella to shield a tennis pro during a tennis lesson.

8. The tennis teaching seat assembly as recited in claim 1, wherein said hinged seat is vertically adjustable on said tennis net post attachable shaft.

9. The tennis teaching seat assembly as recited in claim 1, wherein said tennis post gripping arrangement comprises a rectilinear opening in said first and second bracket.

10. The tennis teaching seat assembly as recited in claim 9, wherein said rectilinear opening has a plurality of cavities therein to permit a post gripping insert to be secured therein.

11. The tennis teaching seat assembly as recited in claim 10, wherein said post gripping insert has an ear arranged externally thereon for receipt in said cavity in said rectilinear opening.

12. The tennis teaching seat assembly as recited in claim 1, wherein said hinged seat is arranged to put tension on a net supported on said tennis net support post when a tennis instructor is viewing a tennis match therefrom.

* * * * *